US009199233B2

(12) United States Patent
Wardlaw

(10) Patent No.: US 9,199,233 B2
(45) Date of Patent: Dec. 1, 2015

(54) BIOLOGIC FLUID ANALYSIS CARTRIDGE WITH DEFLECTING TOP PANEL

(75) Inventor: Stephen C. Wardlaw, Lyme, CT (US)

(73) Assignee: ABBOTT POINT OF CARE, INC., Princton, NJ (US)

( * ) Notice: Subject to any disclaimer, the term of this patent is extended or adjusted under 35 U.S.C. 154(b) by 206 days.

(21) Appl. No.: 13/077,189

(22) Filed: Mar. 31, 2011

(65) Prior Publication Data

US 2011/0243794 A1 Oct. 6, 2011

Related U.S. Application Data

(60) Provisional application No. 61/319,359, filed on Mar. 31, 2010, provisional application No. 61/319,364, filed on Mar. 31, 2010.

(51) Int. Cl.
*B01L 3/00* (2006.01)
*B01L 9/00* (2006.01)

(52) U.S. Cl.
CPC ..... *B01L 3/502715* (2013.01); *B01L 9/52* (2013.01); *B01L 2300/0654* (2013.01); *B01L 2300/087* (2013.01); *B01L 2300/0822* (2013.01); *B01L 2300/0877* (2013.01)

(58) Field of Classification Search
CPC ..... B01L 2300/0877; B01L 2200/025; B01L 2200/12; B01L 2300/0654; B01L 2300/0822; B01L 2300/087; B01L 2300/0887; B01L 2400/0406; B01L 3/5027; B01L 3/502715; B01L 3/502738; B01L 9/52; G01N 33/491; G01N 33/5094; G01N 1/2813; G01N 1/312; G01N 2015/008; G01N 2015/1006; G01N 2015/1486; G01N 2021/0364; G01N 21/03; G01N 35/00009
USPC ..... 422/500–504, 507, 563
See application file for complete search history.

(56) References Cited

U.S. PATENT DOCUMENTS

| | | | |
|---|---|---|---|
| 3,447,863 | A | 6/1969 | Patterson |
| 3,883,247 | A | 5/1975 | Adams |
| 3,895,661 | A | 7/1975 | Praglin et al. |
| 3,916,205 | A | 10/1975 | Kleinerman |
| 3,925,166 | A | 12/1975 | Blume |
| 4,088,448 | A | 5/1978 | Lilja et al. |
| 4,171,866 | A | 10/1979 | Tolles |

(Continued)

FOREIGN PATENT DOCUMENTS

| | | |
|---|---|---|
| EP | 0381501 | 8/1990 |
| EP | 0638799 | 2/1995 |

(Continued)

*Primary Examiner* — Dean Kwak
(74) *Attorney, Agent, or Firm* — O'Shea Getz P.C.

(57) ABSTRACT

A cartridge for analyzing a biologic fluid sample is provided that includes a base plate, a sample inlet port, a first chamber wall, a second chamber wall, and an optically transparent cover panel disposed in contact with the first and second chamber walls. The base plate has a body with a chamber surface, a body passage, and a chamber entry passage. The body passage is in fluid communication with the chamber entry passage, and the chamber entry passage extends through to the chamber surface. The sample inlet port has an inlet passage in fluid communication with the body passage. The first and second chamber walls each have a height extending outwardly from the chamber surface, and the two walls are spaced apart from one another. The cover panel is sufficiently flexible to deflect and contact a central region of the chamber surface.

8 Claims, 4 Drawing Sheets

(56) References Cited

U.S. PATENT DOCUMENTS

| | | | | |
|---|---|---|---|---|
| 4,427,294 | A | 1/1984 | Nardo | |
| 4,550,417 | A | 10/1985 | Nunogaki et al. | |
| 4,558,014 | A | 12/1985 | Hirschfeld et al. | |
| 4,596,035 | A | 6/1986 | Gershman et al. | |
| 4,790,640 | A | 12/1988 | Nason | |
| 4,853,210 | A | 8/1989 | Kass | |
| 4,902,624 | A | 2/1990 | Columbus et al. | |
| 4,911,782 | A | 3/1990 | Brown | |
| 4,950,455 | A | 8/1990 | Smith | |
| 5,028,529 | A | 7/1991 | Ericcson | |
| 5,122,284 | A | 6/1992 | Braynin et al. | |
| 5,132,097 | A | 7/1992 | Van Deusen et al. | |
| 5,169,601 | A | 12/1992 | Ohta et al. | |
| 5,223,219 | A | 6/1993 | Subramanian et al. | |
| 5,275,951 | A | 1/1994 | Chow et al. | |
| 5,281,540 | A | 1/1994 | Merkh et al. | |
| 5,316,952 | A | 5/1994 | Brimhall | |
| 5,362,648 | A | 11/1994 | Koreyasu et al. | |
| 5,397,479 | A | 3/1995 | Kass et al. | |
| 5,427,959 | A | 6/1995 | Nishimura et al. | |
| 5,431,880 | A | 7/1995 | Kramer | |
| 5,482,829 | A | 1/1996 | Kass et al. | |
| 5,547,849 | A | 8/1996 | Baer et al. | |
| 5,591,403 | A | 1/1997 | Gavin et al. | |
| 5,608,519 | A | 3/1997 | Gourley et al. | |
| 5,623,415 | A | 4/1997 | O'Bryan et al. | |
| 5,638,828 | A | 6/1997 | Lauks et al. | |
| 5,646,046 | A | 7/1997 | Fischer | |
| 5,681,529 | A | 10/1997 | Taguchi et al. | |
| 5,768,407 | A | 6/1998 | Shen et al. | |
| 5,781,303 | A | 7/1998 | Berndt | |
| 5,787,189 | A | 7/1998 | Lee et al. | |
| 5,800,781 | A | 9/1998 | Gavin et al. | |
| 5,879,628 | A | 3/1999 | Ridgeway et al. | |
| 5,939,326 | A | 8/1999 | Chupp et al. | |
| 5,948,686 | A | 9/1999 | Wardlaw | |
| 6,004,821 | A | 12/1999 | Levine et al. | |
| 6,016,367 | A | 1/2000 | Benedetti et al. | |
| 6,022,734 | A | 2/2000 | Wardlaw | |
| 6,106,778 | A | 8/2000 | Oku et al. | |
| 6,130,098 | A | 10/2000 | Handique et al. | |
| 6,150,178 | A | 11/2000 | Cesarczyk et al. | |
| 6,235,536 | B1 * | 5/2001 | Wardlaw | 436/172 |
| 6,544,793 | B2 * | 4/2003 | Berndt | 436/8 |
| 6,551,554 | B1 | 4/2003 | Vermeiden et al. | |
| 6,723,290 | B1 * | 4/2004 | Wardlaw | 422/559 |
| 6,766,817 | B2 | 7/2004 | da Silva | |
| 6,866,823 | B2 | 3/2005 | Wardlaw | |
| 7,010,391 | B2 | 3/2006 | Handique et al. | |
| 2002/0025279 | A1 | 2/2002 | Weigl | |
| 2003/0012697 | A1 | 1/2003 | Hahn et al. | |
| 2006/0160164 | A1 | 7/2006 | Miller et al. | |
| 2007/0025876 | A1 | 2/2007 | Nishijima et al. | |
| 2007/0036679 | A1 | 2/2007 | Munenaka | |
| 2007/0243117 | A1 | 10/2007 | Wardlaw | |
| 2007/0254372 | A1 | 11/2007 | Bickel et al. | |
| 2008/0200343 | A1 | 8/2008 | Clemens et al. | |
| 2009/0156966 | A1 | 6/2009 | Kontschieder | |
| 2011/0192219 | A1 | 8/2011 | Miyamura | |
| 2011/0244581 | A1 | 10/2011 | Nikonorov et al. | |
| 2012/0034647 | A1 | 2/2012 | Herzog et al. | |

FOREIGN PATENT DOCUMENTS

| | | |
|---|---|---|
| EP | 1390750 | 2/2004 |
| EP | 1932594 | 6/2008 |
| WO | WO 95/11454 | 4/1995 |
| WO | 9624876 | 8/1996 |
| WO | 2007112332 | 10/2007 |

* cited by examiner

BIOLOGIC FLUID ANALYSIS CARTRIDGE WITH DEFLECTING TOP PANEL

The present application is entitled to the benefit of and incorporates by reference essential subject matter disclosed in U.S. Provisional Patent Application Ser. No. 61/319,359, filed Mar. 31, 2010 and U.S. Provisional Patent Application Ser. No. 61/319,364 filed Mar. 31, 2010.

BACKGROUND OF THE INVENTION

1. Technical Field

The present invention relates to an apparatus for biologic fluid analyses in general, and to cartridges for acquiring, processing, and containing biologic fluid samples for analysis in particular.

2. Background Information

Historically, biologic fluid samples such as whole blood, urine, cerebrospinal fluid, body cavity fluids, etc., have had their particulate or cellular contents evaluated by smearing a small undiluted amount of the fluid on a slide and evaluating that smear under a microscope. Reasonable results can be gained from such a smear, but the cell integrity, accuracy and reliability of the data depends largely on the technician's experience and technique.

In some instances, constituents within a biological fluid sample can be analyzed using impedance or optical flow cytometry. These techniques evaluate a flow of diluted fluid sample by passing the diluted flow through one or more orifices located relative to an impedance measuring device or an optical imaging device. A disadvantage of these techniques is that they require dilution of the sample, and fluid flow handling apparatus.

It is known that biological fluid samples such as whole blood that are quiescently held for more than a given period of time will begin "settling out", during which time constituents within the sample will stray from their normal distribution. If the sample is quiescently held long enough, constituents within the sample can settle out completely and stratify (e.g., in a sample of whole blood, layers of white blood cells, red blood cells, and platelets can form within a quiescent sample). As a result, analyses on the sample may be negatively affected because the constituent distribution within the sample is not a naturally occurring distribution.

What is needed is an apparatus for evaluating a sample of substantially undiluted biologic fluid, one capable of providing accurate results, one that does not require sample fluid flow during evaluation, one that can perform particulate component analyses, and one that is cost-effective.

DISCLOSURE OF THE INVENTION

According to the present invention, a cartridge for analyzing a biologic fluid sample is provided that includes a base plate, a sample inlet port, a first chamber wall, a second chamber wall, and a cover panel. The base plate has a body with a chamber surface, a body passage, and a chamber entry passage. The body passage is in fluid communication with the chamber entry passage, and the chamber entry passage extends through to the chamber surface. The sample inlet port has an inlet passage in fluid communication with the body passage. The first chamber wall has a height extending outwardly from the chamber surface. The second chamber wall has a height extending outwardly from the chamber surface, and is spaced apart from the first chamber wall. The cover panel is disposed in contact with the first and second chamber walls. The cover panel is optically transparent. The cover panel is sufficiently flexible to deflect and contact a central region of the chamber surface when subjected to capillary forces from sample quiescently residing between the cover panel and the base plate chamber surface. The cover panel, first and second chamber walls, and the chamber surface define an analysis chamber.

The features and advantages of the present invention will become apparent in light of the detailed description of the invention provided below, and as illustrated in the accompanying drawings.

BRIEF DESCRIPTION OF THE DRAWINGS

FIG. 2B illustrates a blood sample being drawn into the cartridge inlet passage. FIG. 2C illustrates the inlet passage and the body passage filled with sample and the sample inlet port capped. FIGS. 2D and 2E illustrate an air pressure source connected to the cartridge, moving the sample into the analysis chamber. FIG. 2F illustrates the sample disposed within the analysis chamber with capillary forces drawing the cover panel into contact with the chamber surface in the central region.

FIG. 3B illustrates a blood sample being drawn into the cartridge inlet passage. FIG. 3C illustrates the inlet passage filled with sample and the sample inlet port capped. FIGS. 3D-3F illustrate an air pressure source connected to the cartridge, moving the sample into the analysis chamber. FIG. 3E illustrates the sample bolus moving within the mixing chamber to mix the sample. FIG. 3G illustrates the sample disposed within the analysis chamber with capillary forces drawing the cover panel into contact with the chamber surface in the central region.

DETAILED DESCRIPTION

Figure 1:
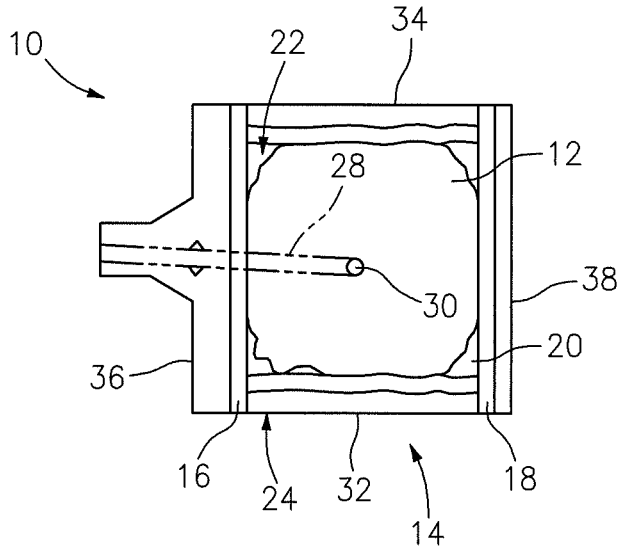
FIG. 1 is a diagrammatic top view of an embodiment of the present invention analysis cartridge.

Referring to FIGS. 1, 2A-2F, and 3A-3G, an analysis cartridge 10 for analyzing a whole blood sample 12 is provided. The cartridge 10 includes a base plate 14, a first chamber wall 16, a second chamber wall 18, and a cover panel 20. The cartridge 10 further includes an analysis chamber 22 defined by the base plate 14, the first and second chamber walls 16, 18, and the cover panel 20. The analysis chamber 22 is operable to quiescently hold a whole blood sample 12. The term "quiescent" is used to describe that the sample 12 is deposited within the analysis chamber 22, and is not purposefully moved during the analysis. To the extent that motion is present within the sample 12, it will predominantly be due to Brownian motion of the sample's formed constituents, which motion is not disabling of the use of this invention.

The base plate 14 has a body 24 with a chamber surface 26, a body passage 28, and a chamber entry passage 30 (see FIGS. 2A-2F and 3A-3G). The body passage 28 and the chamber entry passage 30 are enclosed within the body 24. In the embodiment shown in FIGS. 1, 2A-2F, and 3A-3G, the body 24 has a generally rectangular configuration with a first side surface 32, a second side surface 34, a front side surface 36, and a rear side surface 38. The first and second side surfaces 32, 34 are opposite one another, and the front and rear side surfaces 36, 38 are opposite one another, extending between the first and second side surfaces 32, 34. The base plate 14 is not limited to this geometry, however. FIGS. 2A-2F and 3A-3G show the base plate 14 as a unitary structure. In alternative embodiments, the base plate 14 may comprise a plurality of portions attached to one another. In some embodiments, a portion of the base plate 14 aligned with the analysis chamber 22, or all of the base plate 14, is transparent.

In the cartridge 10 embodiment shown in FIGS. 2A-2F, the body passage 28 has a length 40 and a cross-sectional geometry. The cross-sectional geometry of the body passage 28 is configured such that capillary forces will act on a sample 12 of whole blood within the body passage 28, providing a force capable of propelling the sample 12 toward the chamber entry passage 30. The transition between the body passage 28 and the chamber entry passage 30 is such that fluid within the body passage 28 will not pass into the chamber entry passage 30 as a result of capillary forces. The embodiment shown in FIGS. 2A-2F also includes a sample inlet port 42 attached to the base plate 14. The inlet port 42 has an inlet passage 44 extending between an inlet end 46 and a second end 48. The inlet end 46 opens to an exterior surface 50, and the second end 48 is in fluid communication with the body passage 28. The inlet passage 44 has a cross-sectional geometry similar to that of the body passage 28; i.e., it is sized such that capillary forces will act on a sample 12 of whole blood within the inlet passage 44, and provide a force capable of propelling the sample 12 toward the body passage 28. The inlet passage 44 is in fluid communication with the body passage 28, and the body passage 28 is in fluid communication with the chamber entry passage 30. The combined volumes of the inlet passage 44 and the body passage 28 define a predetermined volume of sample 12 for analysis, as will be explained further below. In this embodiment, the chamber entry passage 30 may have a cross-sectional geometry configured such that capillary forces will not act on a sample 12 of whole blood within the chamber entry passage 30.

In the cartridge 10 embodiment shown in FIGS. 3A-3G, the body passage 28 has a length 52 and a cross-sectional geometry, and is adapted to serve as a mixing chamber (and is referred to hereinafter as a "mixing chamber 28A", for explanation sake). The cross-sectional geometry of the mixing chamber 28A is sized such that capillary forces will act on a sample 12 of whole blood within the mixing chamber 28A. The chamber entry passage 30 may have a cross-sectional geometry configured such that capillary forces will act on a sample 12 of whole blood within the chamber entry passage 30, providing a force capable of propelling the sample 12 toward the analysis chamber 22. The length 52 of the mixing chamber 28A may be long enough such that a bolus of sample 12 moved through the length of the mixing chamber 28A will be adequately mixed. Alternatively, a shorter length may be used; i.e., one that allows cycling of a sample bolus 12 back and forth within the mixing chamber 28A to accomplish adequate mixing. The embodiment shown in FIGS. 3A-3G also includes a sample inlet port 42 attached to the base plate 14. The inlet port 42 has an inlet passage 44 extending between an inlet end 46 and a second end 48. The inlet end 46 opens to an exterior surface 50, and the second end 48 is in fluid communication with the mixing chamber 28A. The inlet passage 44 has a cross-sectional geometry such that capillary forces will act on a sample 12 of whole blood within the inlet passage 44, and provide a force capable of propelling the sample 12 toward the mixing chamber 28A. The inlet passage 44 is in fluid communication with the mixing chamber 28A. The volume of the inlet passage 44 is a predetermined volume adequate for the analysis at hand. A fluid stop region 54 is a region of expanded area disposed between the inlet passage 44 and the mixing chamber 28A. The configuration of the fluid stop region 54 is such that fluid drawn into the inlet passage 44 will not pass into the mixing chamber 28A as a result of capillary forces.

Figure 2A:
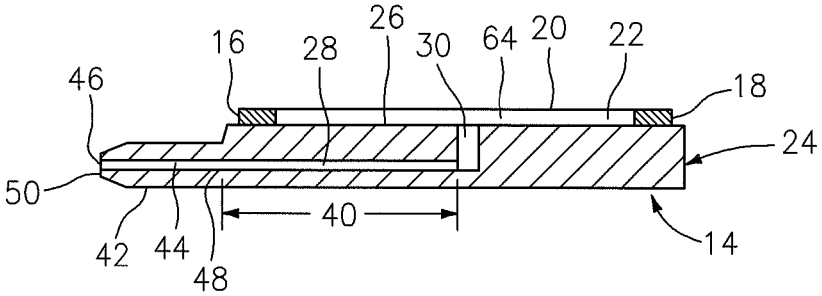
FIGS. 2A-2F are diagrammatic sectional views of an embodiment of the present analysis cartridge.
Figure 2B:
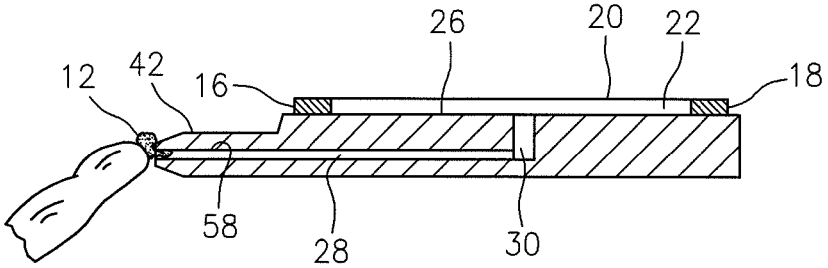
Figure 2C:
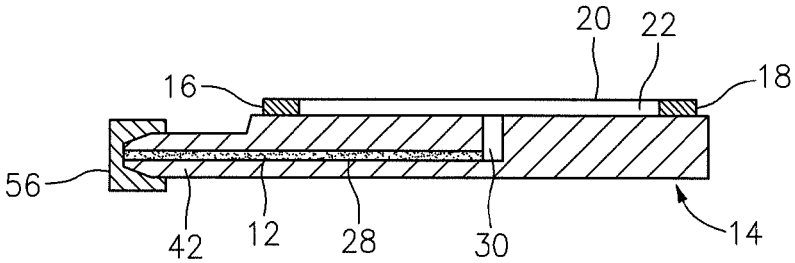
Figure 2D:
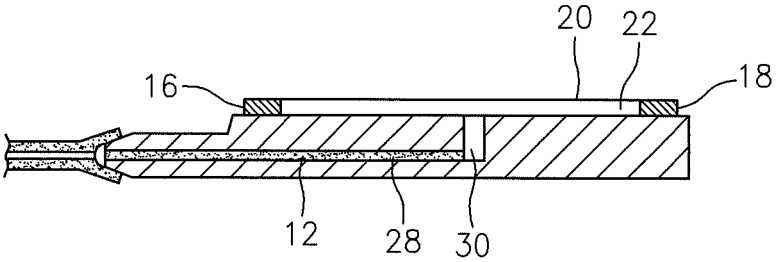
Figure 2E:
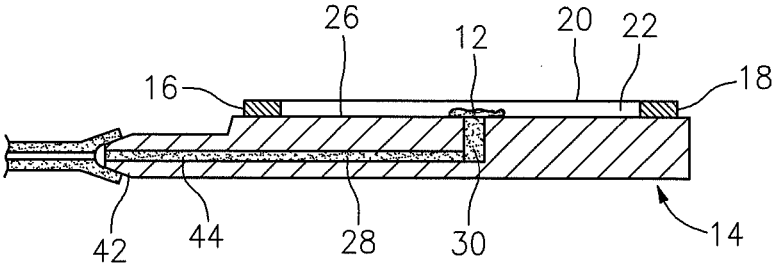
Figure 3A:
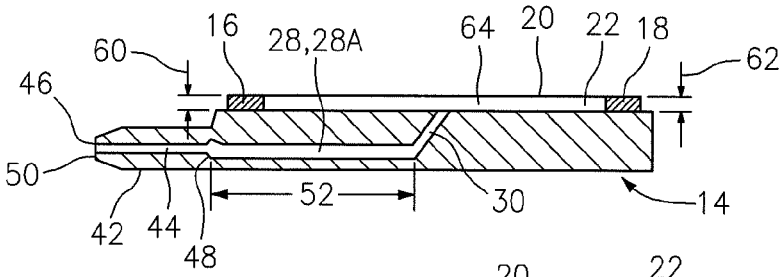
FIGS. 3A-3G are diagrammatic sectional views of an embodiment of the present analysis cartridge.
Figure 3B:
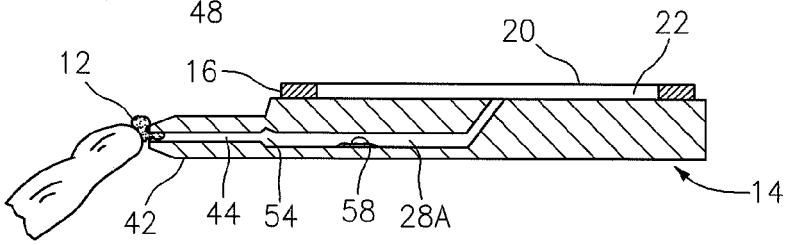
Figure 3C:
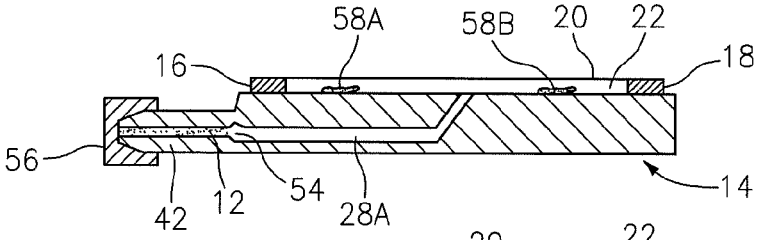
Figure 3D:
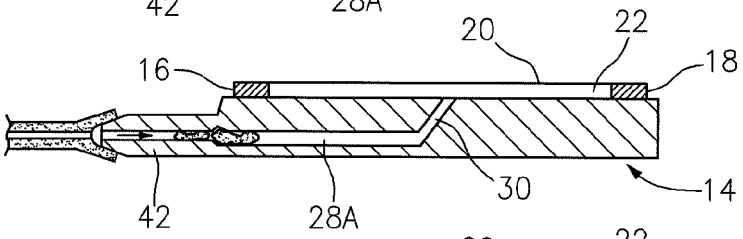
Figure 3E:
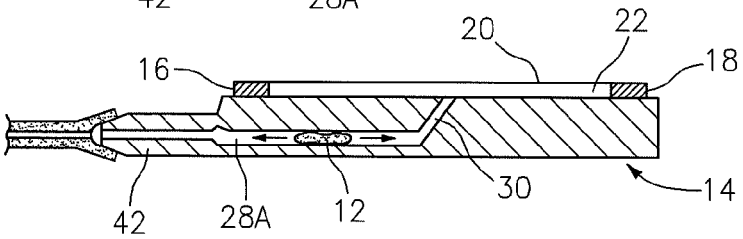
Figure 3F:
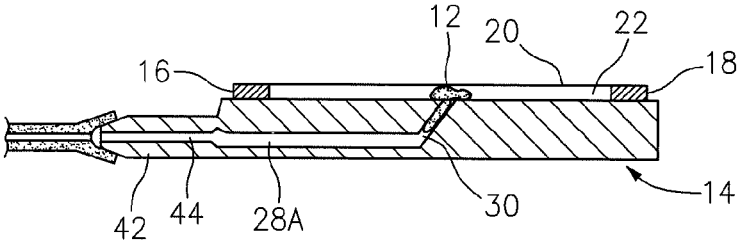

In the embodiments shown in FIGS. 2C and 3C, the sample inlet ports 42 each include a cap 56 for sealing the inlet end 46 of the inlet passage 44 to prevent the passage of fluid in or out of the inlet passage 44. The sample inlet ports 42 are described above as being attached to the base plate 14. In alternative embodiments, the sample inlet ports 42 may be integrally formed with the base plate 14.

In some embodiments of the present cartridge 10, one or more reagents 58 (e.g., heparin, EDTA, etc.) may be deposited in one or more of the inlet passage 44, body passage 28, chamber entry passage 30, and the analysis chamber 22. For example, a reagent 58 in dried form may be deposited in any one or more of the identified passages (e.g., see FIG. 2B or FIG. 3B) or chambers, which reagent 58 is hydrated and mixed with the sample 12 upon contact with the sample 12. As will be explained below, the analysis chamber 22 divides into sub-chambers 122, 222 (see FIGS. 2F, 3G, and 7). In these instances, a first reagent 58A (see FIG. 7) can be positioned in one of the sub-chambers 122 and a second reagent 58B (see FIG. 7) positioned in another of the sub-chambers 222.

The first and second chamber walls 16, 18 extend outwardly from the base plate 14, with the chamber surface 26 extending therebetween. The walls 16, 18 are spaced apart from each other by a distance that in part defines the analysis chamber 22. In the embodiment shown in FIGS. 1, 2A-2F, and 3A-3G, the first and second chamber walls 16, 18 are parallel. The first chamber wall 16 has a height 60 and the second chamber wall 28 has a height 62, which heights are selected according to the analysis to be performed in the analysis chamber 22. The heights are such that sample fluid disposed within the analysis chamber 22 will exert capillary forces on the cover panel 20, causing it to draw toward the base plate chamber surface 26. In preferred embodiments, the heights 60, 62 of the first and second chamber walls 16, 18 are such that capillary forces acting on the sample 12 within the analysis chamber 22 are greater than those acting on the sample 12 within the chamber entry passage 30, which, as will be described below, facilitates sample capillary flow out of the chamber entry passage 30 and into the analysis chamber 22. The chamber entry passage 30 extends through to the chamber surface 26 in a central region 64 of the chamber surface 26, which central region 64 is centrally located between the first and second chamber walls 16, 18. The first and second chamber walls 16, 18 are fixed to the base plate 14, or are integrally formed with the base plate 14. Lines 66 of hydroscopic material may be deposited on the chamber surface 26, extending between the first and second chamber walls 16, 18 to define the expanse of the analysis chamber 22, or subsections within the chamber. The first and second chamber walls 16, 18 shown in FIGS. 1, 2A-2F, and 3A-3G are substantially equal in height. In alternative embodiments, the first and second chamber walls 16, 18 may have different heights; e.g., the first chamber wall 16 in FIG. 4 has a first chamber height 60 equal to "x", and the second chamber wall 18 has a height 62 equal to "y", where y<x.

The cover panel 20 is disposed in contact with the first and second chamber walls 16, 18. The cover panel 20 is optically transparent. The distance between the chamber walls 16, 18 and the flexibility of the cover panel 20 are such that the cover panel 20 will deflect and contact the chamber surface 26 in the central region 64 where the chamber entry passage 30 is disposed when subjected to capillary forces from a sample 12 quiescently residing between the cover panel 20 and the base plate chamber surface 26. An example of an acceptable cover panel 20 material is a polyester film such as the Mylar brand polyester film marketed by DuPont Teijin, Chester, Va., U.S.A. The analysis chamber 22 is defined by the base plate chamber surface 26, the first and second chamber walls 16, 18, and the cover panel 20, and is typically sized to hold about 0.2 to 1.0 μl of sample 12. The analysis chamber 22 is not limited to any particular volume capacity, and the capacity can vary to suit the analysis application.

Figure 5:
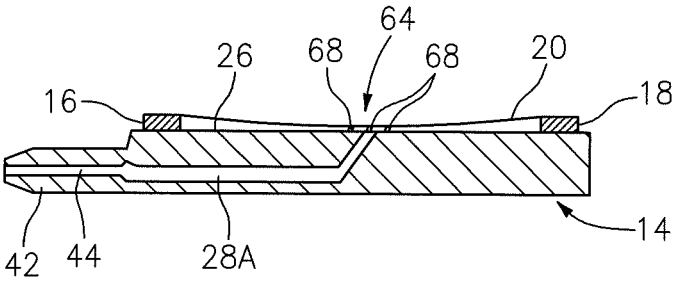
FIG. 5 is a diagrammatic sectional view of an embodiment of the present analysis cartridge, including separators disposed in the central region of analysis chamber.

Now referring to FIG. 5, in some embodiments uniformly sized separators 68 (e.g., beads) are disposed in the central region 64 of the analysis chamber 22 proximate the chamber entry passage 30. In these embodiments, the cover panel 20 will deflect when subjected to the capillary forces and contact the separators 68 and a local analysis chamber region of constant height is created. A volumetric calibration can be accomplished in this area using the known height of the separators 68.

Figure 6:
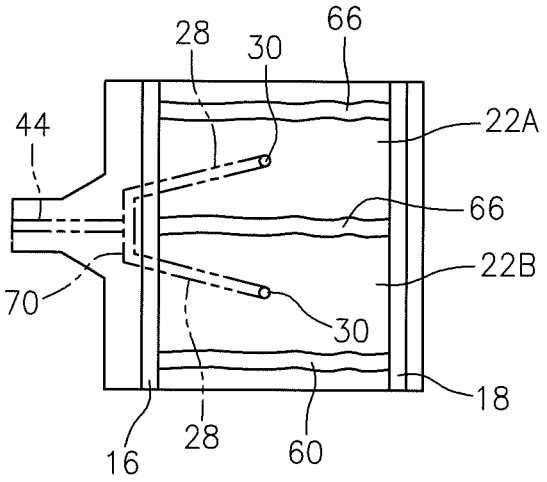
FIG. 6 is a diagrammatic top view of an embodiment of the present analysis cartridge, including a plurality of analysis chambers.

The cartridge 10 embodiments shown in FIGS. 1, 2A-2F, and 3A-3G illustrate a cartridge 10 that has a single analysis chamber 22. In alternative embodiments, the cartridge 10 may have more than one analysis cartridge 10 configured in the manner described above. For example, the cartridge 10 diagrammatically shown in FIG. 6 includes a first and second analysis chamber 22A, 22B. A manifold 70 (shown in phantom) in communication with the sample inlet port 42 directs sample 12 toward both of the analysis chambers 22A, 22B. Each analysis chamber 22A, 22B may be configured for a different analysis on different parts of the same fluid sample 12.

Figure 7:
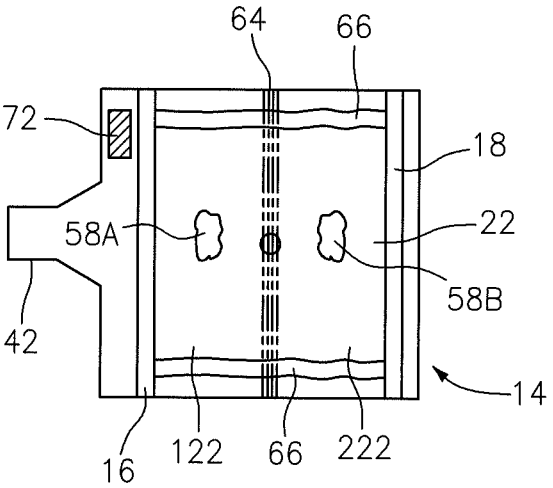
FIG. 7 is a diagrammatic top view of an embodiment of the present analysis cartridge, illustrating the central region where the cover panel contacts the chamber surface when subjected to capillary forces from a sample quiescently residing between the cover panel and the base plate chamber surface.

Now referring to FIG. 7, in some embodiments the cartridge 10 may include a calibration reference 72 such as a well of known depth containing sample hemoglobin, or a pad of material with stable characteristics which can be referenced to calibrate the response of the reagent.

Figure 8:
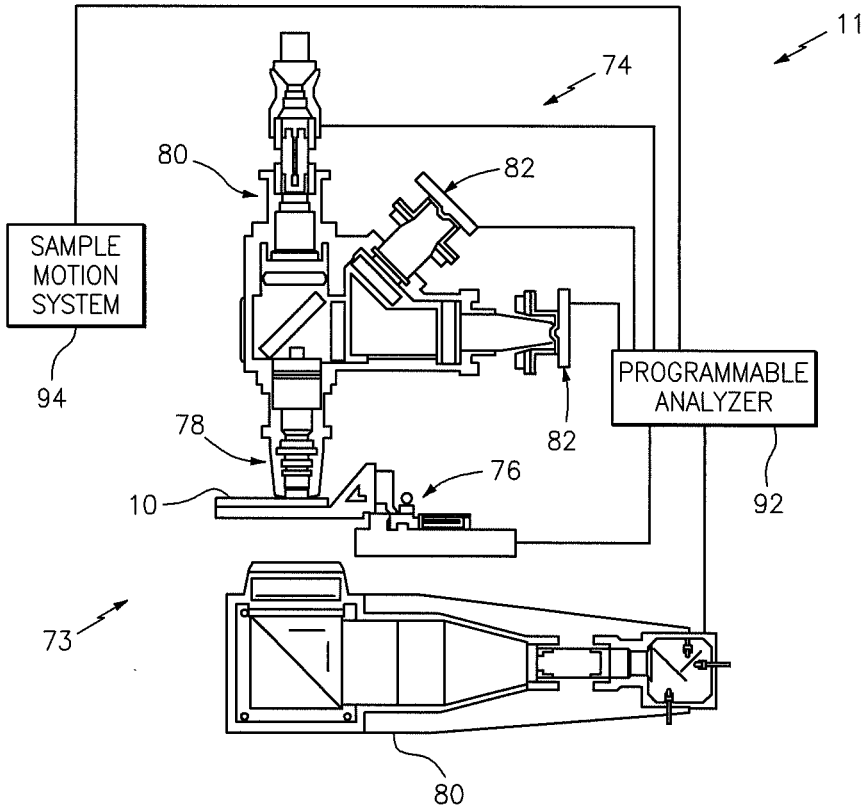
FIG. 8 is a diagrammatic view of an analysis device in which the present cartridge can be utilized as part of an automated analysis system.

In most instances the above described cartridge 10 embodiments are a part of an automated analysis system 11 that includes the cartridge 10 and an analysis device 73. An example of an analysis device 73 is schematically shown in FIG. 8, depicting its imaging hardware 74, a cartridge holding and manipulating device 76, a sample objective lens 78, a plurality of sample illuminators 80, a plurality of image dissectors 82, a programmable analyzer 92, and a sample motion system 94. One or both of the objective lens 78 and cartridge holding device 76 are movable toward and away from each other to change a relative focal position. The sample illuminators 80 illuminate the sample 12 using light along predetermined wavelengths. Light transmitted through the sample 12, or fluoresced from the sample 12, is captured using the image dissector 82, and a signal representative of the captured light is sent to the programmable analyzer 92, where it is processed into an image. The sample motion system 86 includes a bidirectional fluid actuator that is operable to produce fluid motive forces that can move fluid sample 12 within the cartridge passages 28 in either axial direction (i.e., back and forth).

Operation:

In the operation of the cartridge 10, a volume of fluid sample 12 (e.g., whole blood) to be analyzed is disposed in contact with the inlet end 46 of the sample inlet port 42. The volume of sample 12 may be provided from a finger prick or ear prick, or from blood within a collection vessel (e.g., a Vacutainer®). The sample 12 is drawn into the inlet passage 44 by capillary forces.

In the cartridge 10 embodiment shown in FIGS. 2A-2F, the sample 12 travels through the inlet passage 44 and into the body passage 28, stopping at the interface with the chamber entry passage 30. Once the inlet passage 44 and the body passage 28 are filled with sample 12, a cap 56 is placed on the sample inlet port 42 to seal the inlet end 46. In the cartridge 10 embodiment shown in FIGS. 3A-3G, the sample 12 travels through the inlet passage 44, stopping at the interface with the mixing passage 28A. Once the inlet passage 44 is filled with sample 12, the cap 56 is placed on the sample inlet port 42 to seal the inlet end 46. In many embodiments, an anticoagulant reagent 58 is disposed in the inlet passage 44, where it mixes with the sample 12 to prevent coagulation of the sample prior to analysis. After the cap 56 is placed on the sample inlet port 42, the cartridge 10 may be transported to the analysis device 73 and/or stored for a relatively short period of time until the analysis can be performed.

To perform the analysis, the cartridge 10 is disposed within the analysis device 73 (see FIG. 8) and a source of pressurized air from the sample motion system 86 is connected with the sample inlet port 42. The pressurized air is selectively applied to move the sample 12 within the cartridge 10 (see FIGS. 2D-2E and 3D-3F).

In terms of the embodiment in shown in FIGS. 2A-2F, the sample motion system 86 moves the sample 12 into the chamber entry passage 30 and subsequently into contact with the analysis chamber 22. Once the sample 12 is in contact with the analysis chamber 22, capillary forces draw the sample 12 into the analysis chamber 22, causing it to laterally disperse within the analysis chamber 22.

In terms of the embodiment shown in FIGS. 3A-3G, the sample motion system 86 moves the sample 12 into the mixing passage 28A where the sample 12 can be moved within the mixing passage 28A (e.g., cycled back and forth) to mix the sample 12 itself or to mix a reagent 58 with the sample 12. Once the sample 12 is mixed, the sample motion system 86 is operated to move the sample 12 either into contact with the chamber entry passage 30 (if the chamber entry passage 30 is sized for capillary flow), or completely into the chamber entry passage 30 and subsequently into contact with the analysis chamber 22. Once the sample 12 is in contact with the analysis chamber 22, capillary forces draw the sample 12 into the analysis chamber 22, causing it to laterally disperse within analysis chamber 22.

Figure 2F:
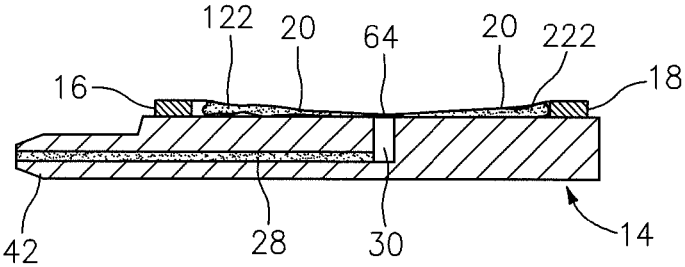
Figure 3G:
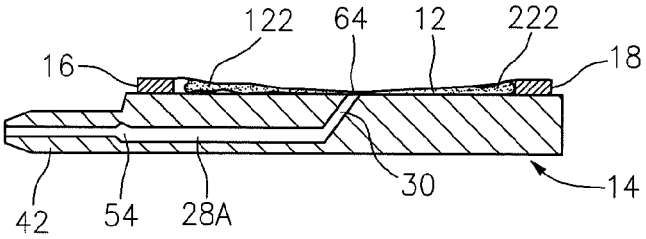
Figure 4:
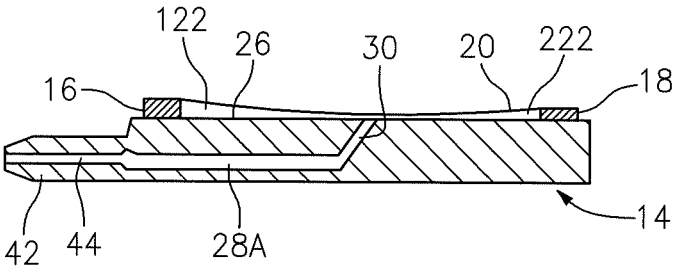
FIG. 4 is a diagrammatic sectional view of an embodiment of the present analysis cartridge having chamber walls of different heights.

Once the sample 12 is disposed in the analysis chamber 22, the capillary forces act on the cover panel 20 causing it to draw toward the chamber surface 26 of the base plate 14 (e.g., see FIGS. 2F and 3G). In the absence of an obstruction (e.g., separator beads 68 shown in FIG. 5), the cover panel 20 will contact the central region 64 of the base plate chamber surface 26, effectively dividing the analysis chamber 22 into two smaller sub-chambers 122, 222 (e.g., see FIGS. 2F, 3G, and 7). If the first and second chamber walls 16, 18 have equal heights 60, 62, the sub-chambers 122, 222 each have the same physical configuration. In those embodiments where the first and second chamber walls 16, 18 have different heights 60, 62 (e.g., see FIG. 4), the sub-chambers 122, 222 have different configurations; e.g., different configurations for different analyses, thereby increasing the utility of the cartridge 10. For example, for an analysis of whole blood the first chamber wall 16 may have a height that is substantially equal to the height of a spherized red blood cell (RBC), and the second chamber wall 18 may have the height that is substantially equal to the height of a white blood cell (WBC). The difference in sub-chamber 122, 222 configurations can facilitate separation of the RBC and WBC populations. Alternatively, or in addition, the sub-chambers 122, 222 can also include different reagents; i.e., a first reagent 58A in one sub-chamber 122 for a first analysis, and a second reagent 58B in another sub-chamber 222 for a second, different analysis.

The present invention advantageously allows for volumetric calibration for the analyses based on volume (e.g., cell volume (CV), mean cell volume (MCV), hemoglobin content (Hgb), hemoglobin concentration, etc.). For example, in those embodiments that use uniformly sized separators 68 disposed in the central region 64 of the analysis chamber 22, the known constant height of the separators 68 and the area of the imaging field can be used to determine the volume. Alternatively, the present cartridge 10 is configured to accept a known volume of sample 12 through the sample inlet port 42. If a know amount of colorant (e.g., acridine orange) is disposed within the passages to mix with the sample 12, the concentration of the colorant can be determined and the height of an analysis field and associated volume can be determined there from. Volumetric information can also be determined from RBCs. In an area of the chamber where a RBC can contact both the chamber surface 26 of the base plate 14 and the cover panel 20, the integral optical density (OD) of a statistically significant number of the RBCs can be determined and an OD/RBC value can be detenuined. In areas of the chamber (or sub-chambers) where the height is greater than a RBC, the integral value of the OD for a RBC (at a wavelength where plasma has no appreciable effect on the OD) can be used to determine the number of RBCs in an analysis field. The number of WBCs within a given sample field can be related as a ratio with the number of RBCs within the field. The collected information can then be used to determine other blood analysis parameters.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

What is claimed is:

1. A cartridge for analyzing a biologic fluid sample, comprising:

a base plate having a body with a chamber surface, a body passage, and a chamber entry passage, wherein the body passage is in fluid communication with the chamber entry passage, and the chamber entry passage extends through to the chamber surface;

a sample inlet port having an inlet passage in fluid communication with the body passage;

a first chamber wall having a height extending outwardly from the chamber surface;

a second chamber wall having a height extending outwardly from the chamber surface, spaced apart from the first chamber wall; and a cover panel disposed in contact with the first and second chamber walls, wherein the cover panel, first and second chamber walls, and the chamber surface define an analysis chamber;

wherein the cover panel is optically transparent, and the cover panel includes a material which enables the cover panel to be sufficiently flexible to deflect and contact a central region of the chamber surface when subjected to capillary forces from the sample quiescently residing between the cover panel and the base plate chamber surface, and thereby separate the analysis chamber into a first sub-chamber disposed on a first side of the contact between the cover panel and the central region, and into a second sub-chamber independent from the first sub-chamber on a second side of the contact between the cover panel and the central region, opposite the first side.

2. The cartridge of claim 1, wherein a first reagent is disposed in the first sub-chamber and a second reagent is disposed in the second sub-chamber, wherein the first reagent is different from the second reagent.

3. The cartridge of claim 1, wherein the height of the first chamber wall is greater than the height of the second chamber wall.

4. The cartridge of claim 1, wherein the base plate further includes a manifold, a plurality of body passages, and a plurality of analysis chambers, wherein the inlet passage is in fluid communication with the manifold, and each body passage is in fluid communication with the manifold and one of the analysis chambers.

5. The cartridge of claim 1, further comprising a calibration reference.

6. The cartridge of claim 1, further comprising a plurality of separators of uniform height disposed in the central region.

7. The cartridge of claim 1, wherein the material is a film material.

8. The cartridge of claim 7, wherein the material is a polyester film material.

* * * * *